United States Patent [19]

Evans et al.

[11] 3,943,723

[45] Mar. 16, 1976

[54] MINE ROOF SUPPORT EQUIPMENT

[75] Inventors: Frank Evans, Tamworth; Dennis Alfred Gillard, Burton-on-Trent, both of England

[73] Assignee: Coal Industry (Patents) Limited, London, England

[22] Filed: Apr. 9, 1974

[21] Appl. No.: 459,376

[30] Foreign Application Priority Data

Apr. 27, 1973 United Kingdom ..... 20034/73

[52] U.S. Cl. ..... 61/45 D

[51] Int. Cl.[2] ..... E21D 19/02

[58] Field of Search ..... 61/45 D; 40/128, 144; 98/50; 182/196

[56] References Cited

UNITED STATES PATENTS

| | | | |
|---|---|---|---|
| 2,943,696 | 7/1960 | Roberts | 182/196 |

FOREIGN PATENTS OR APPLICATIONS

| | | | |
|---|---|---|---|
| 1,758,784 | 2/1971 | Germany | 61/45 D |
| 108,441 | 12/1927 | Austria | 40/144 |
| 1,273,850 | 9/1961 | France | 98/50 |
| 1,945,980 | 3/1971 | Germany | 61/45 D |

*Primary Examiner*—Robert L. Wolfe
*Assistant Examiner*—David H. Corbin
*Attorney, Agent, or Firm*—Stevens, Davis, Miller & Mosher

[57] ABSTRACT

Advanceable roof-supports on a longwall face are provided with a shield assembly for preventing flow of broken rock material from the goaf, the shield assembly being made up of a series of shield units each comprising two lengths of round link chain suspended from a roof-support canopy and a plurality of overlapping cross members connected to the chain links by pivotal mounting means.

4 Claims, 7 Drawing Figures

MINE ROOF SUPPORT EQUIPMENT

This invention relates to mine roof-support equipment and in particular to mine roof-support equipment for forming shield assemblies on longwall faces for preventing broken rock material spilling from the goaf towards the working faces.

It is known to support the mine roof of a longwall face by a plurality of mine roof-supports which advance with the working face to leave a goaf which is allowed to collapse behind the line of roof-supports as the working face advances. Each of the mine roof-supports is advanced in succession by releasing the support from its roof engaging positions, advancing it towards the working face and resetting it to its roof supporting position. Once a roof-support is advanced the next adjacent support is advanced in a similar manner and the whole procedure repeated until all the roof-supports along the length of the longwall face are in the advanced position. Each of the mine roof-supports comprises a base advanceable over the mine floor, at least one extensible prop mounted on the base, and a roof component supported by the prop. It is also known to have shield assemblies suspended from the roof components with the aim of forming an effectively continuous or closed curtain which extends between the mine roof and floor along the length of the longwall face and which upon the collapse of the goaf behind the advancing roof-supports tends to retain the broken rock material within the goaf and prevent it flowing towards the working face. A shield assembly may be suspended from a single roof component or it may be suspended from two adjacent roof components. One such known shield assembly comprises a plurality of lengths of round link chain each secured to a roof component so as to hang from the roof component. A plurality of horizontal slats are rigidly secured by welding between the links of the supporting chains, each slat being secured adjacent its ends to the supporting chains, respectively. If both the chains of such a shield assembly are secured to the same roof-support then the shield assembly tends to be sufficiently flexible to allow its effective height to vary to accommodate release of the roof-support away from engagement with the mine roof to facilitate advance of the roof-support. However, such a known shield assembly suffers from the disadvantage that when the supporting chains are suspended from the roof components of adjacent roof-supports they tend not to be sufficiently flexible to allow one roof-support to be released from the roof without gaps being formed in the curtain. Since the slats are rigidly secured to the links of the chains, when a roof-support is released from its supporting position the slats tend to be supported solely by the links of the chain mounted on the non-released roof-support. Thus, the slats exert an unbalanced force on the supporting chain which thereby tends to hang in a non vertical position. Consequently, gaps are formed in the curtain on each side of the inclined shield assembly and broken rock material can flow from the goaf towards the working face. When the advanced roof-support is reset to its roof supporting position it is likely that any broken rock material which flowed through the gaps in the curtain will tend to foul the inclined shield assembly when the roof-support is being reset and thereby tend to prevent the shield assembly moving back into the desired vertical position. Thus once gaps have been formed in the curtain it may be difficult to re-establish an effectively continuous or closed curtain and the shield assemblies may prove ineffective.

An object of the present invention is to provide a mine roof-support equipment which tends to overcome the above mentioned disadvantage.

According to the present invention, mine roof-support equipment for forming a shield assembly behind an advanceable mine roof-support on a longwall face comprises two members each of which is suspendable from a mine roof-support roof component, at least one cross element securable to the two members, and pivotal mounting means for securing the cross element to each member.

Preferably, each of the cross members is flexible and in which case each flexible member may comprise a length of round link chain.

Advantageously, the equipment comprises a plurality of cross elements which may comprise elongated slats, each slat overlapping an adjacent slat.

Preferably, the slats are generally rectangular with the corners cut away.

Conveniently, the pivotal mounting means comprise a pivot pin secured to a chain link.

Preferably, the pivot pin is adapted to receive a lock nut which retains the element on the pivot pin but allows the element to freely pivot about the pin.

Advantageously, bracket means are provided for securing each member to the supporting roof component.

The invention also provides mine roof-support equipment in combination with the mine roof-supports.

By way of example only, one preferred embodiment of the present invention will be described with reference to the accompanying drawings, in which.

Figure 1:
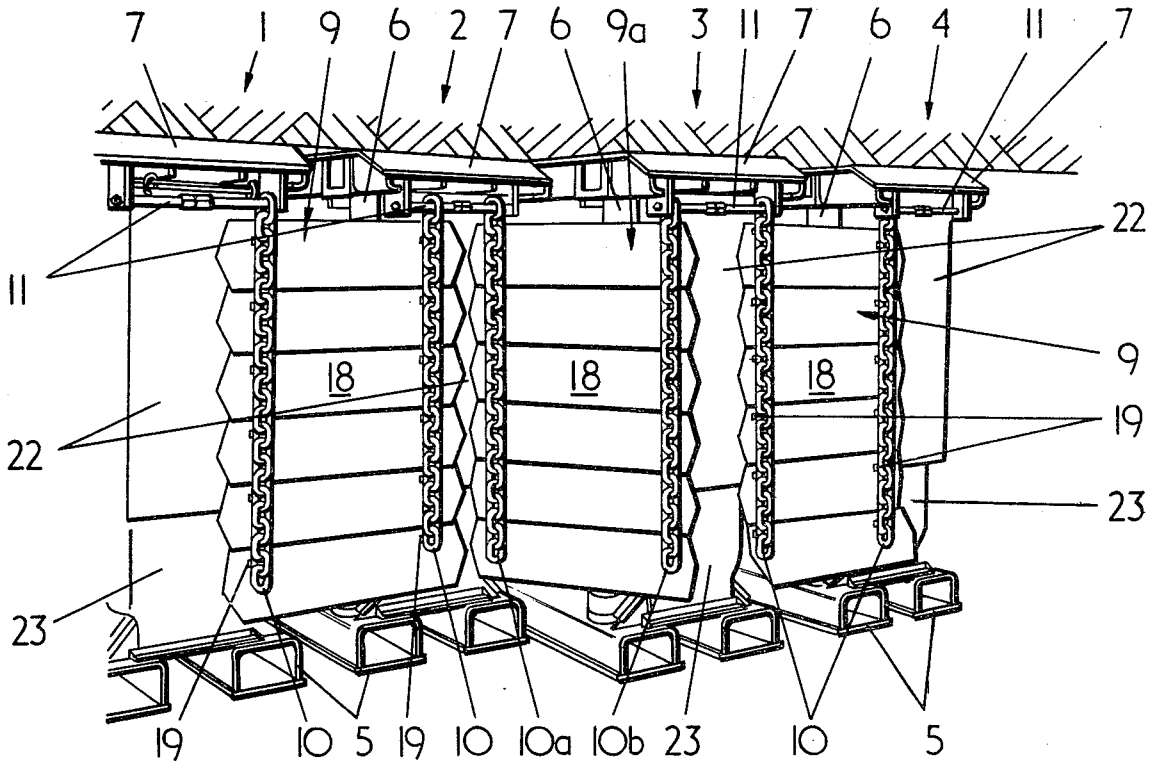
FIGS. 1 to 4 are rear views of a plurality of advanceable mine roof-supports in different operational positions, the supports being provided with mine roof-support equipment forming a shield assembly and constructed in accordance with the present invention.

FIGS. 1 to 4 of the drawings show the rear of four adjacent mine roof-supports 1, 2 3 and 4 arranged along a portion longwall coal face. The supports are advanced towards the working face (which cannot be seen in the drawings) as the face advances to leave a goaf which is allowed to collapse behind the line of the roof-supports. In FIGS. 1 to 4 the roof-supports are viewed from the goaf which in practice normally would be filled with broken rock material from the collapsed mine roof.

Each of the mine roof-supports is advanced in succession by releasing the support from its roof supporting position, advancing it towards the working face and resetting it to its roof supporting position. Once a roof-support is advanced the next adjacent support is advanced in a similar manner and the whole procedure repeated until all the roof-supports along the length of the longwall face are in the advanced position. In FIGS. 1 to 4 of the drawings the roof-support 3 is shown at different stages of its advance.

Each of the roof-supports comprises a base 5 slidable over the mine floor, four hydraulically extensible props 6 (only some of which can be seen) and a roof component 7 supported by the props. Hydraulic control equipment is provided on each roof-support to control the actuation of the props 6 and of an advancing ram (not shown) secured between the roof-support and an armoured face conveyor (not shown) arranged along the length of the working face.

The roof-supports are fitted with roof-support equipment comprising shield assemblies 9 which are described with reference to FIGS. 1 to 7 of the drawings (only three assemblies 9 are shown in FIGS. 1 to 4). Each assembly 9 includes two lengths of round link chain 10 secured to and suspended from the roof components 7 of two adjacent mine roof-supports, respectively. The upper link of each chain 10 is engaged around a rod 11 located at the rear of the associated roof component 7. Alternatively, a shackle is provided between the chain and the rod. Each end of each rod 11 is engaged in a bore 12 (see FIG. 5) formed in a bracket 13 having a clevis 14 the limbs of which are located on opposite sides of a flange 15 of the roof component 7. The lower limb of the clevis 14 has a threaded bore 16 within which is located a clamping bolt (not shown). By turning the clamping bolt the clevis 14 and hence the bracket 13 is releasably secured to the roof component 7 of the mine roof support. The rod 11 is retained in position on the brackets 13 by nuts 17 located on the ends of the rod 11.

Figure 7:
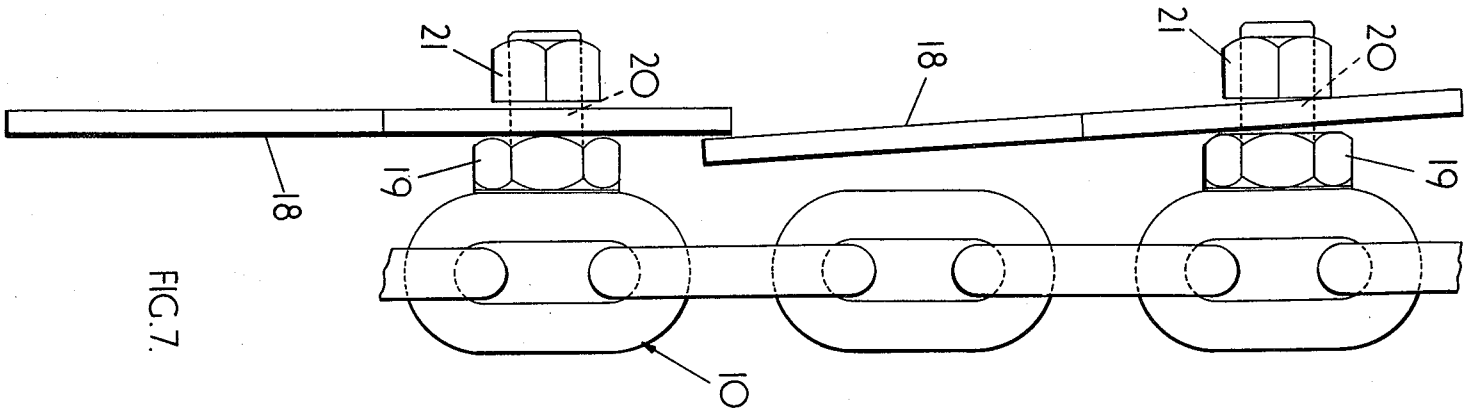
FIG. 7 is a side view of the part of the equipment of FIG. 6 on an enlarged scale.

A plurality of overlapping, rigid slats 18 are pivotally secured to two chains 10 of adjacent roof supports so that the slats bridge across the space between the two adjacent roof-supports. Each slat is generally rectangular with the corners cut away to form pointed ends. The reason for this will be made clear later in the specification. Each of the pivotal mounting means for the slats comprises a bolt 19 (see FIG. 7) the head of which is welded to a link of the associated chain 10 and the shank of which is located in a bore 20 formed adjacent to one end of the slat. As can be seen in FIG. 7 the bore 20 is located towards the uppermost margin of the slat. A locking nut 21 is screwed on the threaded portion of the shank to retain the slot on the non-threaded portion of the shank which is of sufficient length to ensure the slat is not clamped on the bolt and is free to pivot about the bolt shank.

A plate 22 is secured to the rear of each roof-support intermediate two shield assemblies 9, the plate 22 overlapping a plate 23 on the base 5 so as to close the rear portion of the associated roof-support. Alternatively, the plate 23 may be secured between the bases 5 of two adjacent supports.

The advance of the roof-supports will be described with reference to FIGS. 1 to 4 of the drawings and in particular to the advance of the roof supports 3.

In FIG. 1, all the roof-supports along the longwall face preceding roof support 3 have been advanced, including the roof-supports 1 and 2. It can be seen in FIG. 1 that the roof-supports 1 and 2 are set in a roof supporting position in advance of the roof supports 3 and 4. It can also be seen that the shield assemblies 9 provides an effectively continuous or close curtain extending along the length of the longwall face and therefore prevents broken rock material flowing from the goaf towards the working face in advance of the roof-supports. The shield assembly **9*a* effectively bridges the extended space between the last advanced roof-support 2 and the first trailing roof-support 3. In order to accommodate the extended space between the roof-supports 2 and 3 the chains 10*a* and/or 10*b* of the shield assembly 9*a* have slid along their associated rods 11 towards the brackets 13. The space between the shield assembly 9*a* when in this position and the next adjacent shield assemblies 9 is bridged by the plates 22 secured to the rear of the roof-supports 2 and 3.** Thus, an effectively continuous or closed curtain is maintained between the advanced and trailing roof-supports.

Figure 2:
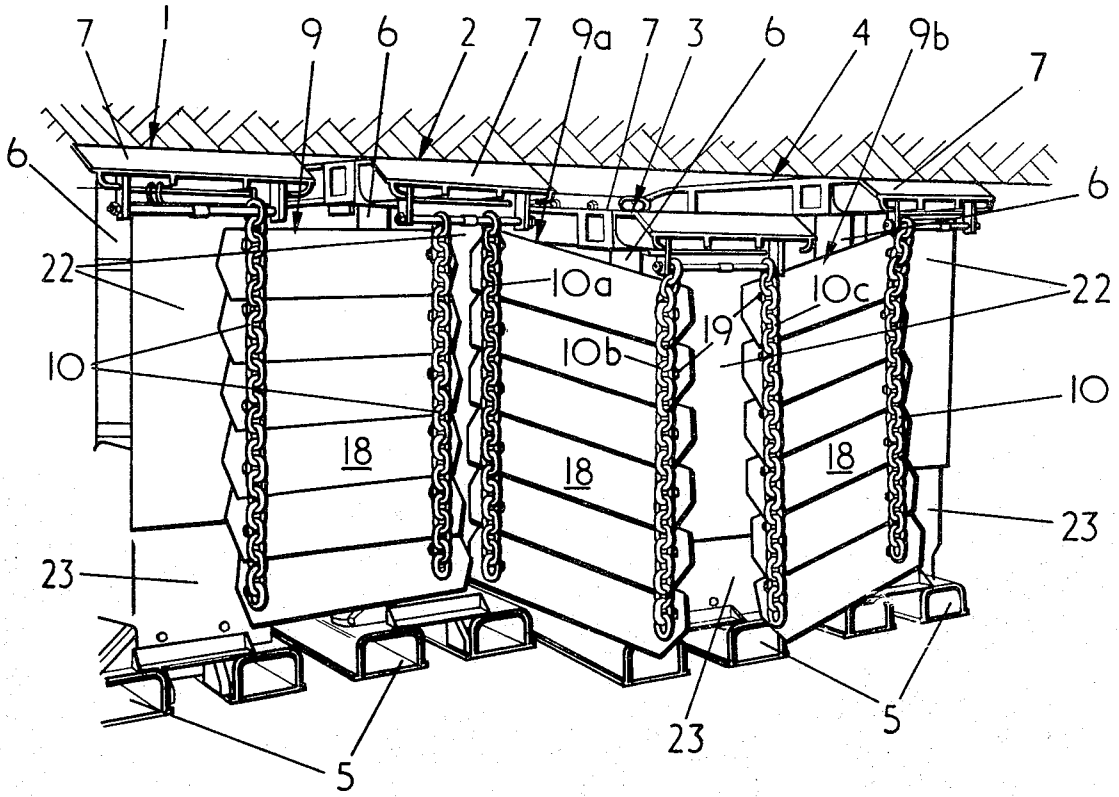

FIG. 2 shows the position when the trailing roof-support 3 is released from its supporting position and its roof component 7 is released from engagement with the mine roof by the rotation of the hydraulic props due to the actuation of the hydraulic control.

When the roof component 7 lowers from the mine roof the chains **10*b* and 10*c* secured to the rear of the roof components are free to move down with the roof component and to slide along the associated rods 11. Since the slats constituting the shield assemblies 9*a* and 9*b* are free to pivot about their support mountings there is no tendency for unbalance loading on the chains to occur. Thus the slats are free to take up an inclined position as shown in FIG. 2. Again it will be noticed that the curtain remains effectively continuous or closed and there is no gap through which broken rock material can flow. With the slats inclined as shown in FIG. 2 it will be seen that the tapered edges along the lower left hand cut away corners (as seen in the FIG. 2) of the slats of shield assembly 9*a* about the associated sheet 22 and no gap is formed between the shield assembly 9*a* and the sheet 22. The same remarks apply regarding the tapered edges along the lower righthand cut away corners (as seen in FIG. 2) of the slats of shield assembly 9*b* which abut the plate 22 of the roof support 4.**

If the lower edges of the slats had not been tapered, then, when the slats were inclined a substantial gap would have been formed between the associated plate 22 and the associated ends of the slats.

Figure 3:
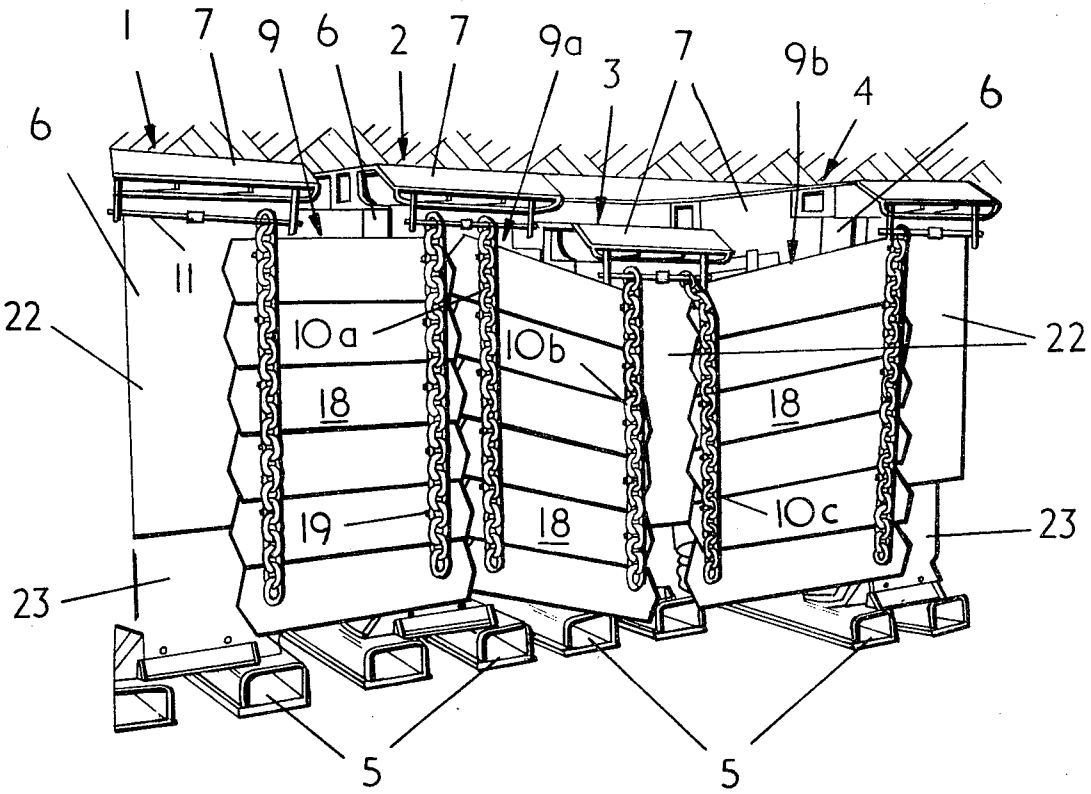

The "released" roof-supports 3 is then advanced towards the working face by the previously mentioned advancing ram until it reaches the position as shown in FIG. 3. Again it will be noticed that an effectively continuous or closed curtain is maintained. With the "released" roof-support fully advanced it can be seen that the tapered edges along the upper left hand corners (as seen in FIG. 3) of the slats 18 of the shield assembly **9*b* abut the plate 22 at the rear of the support 3. Consequently no gaps are formed between the plate 22** and the associated ends of the slats.

The shield assembly **9*b* effectively bridges the extended space between the last advanced roof-support 3 and the first trailing roof-support 4, the associated chains 10 sliding along the rods 11 towards the brackets 13** to accommodate the extended space.

The chains 10 of the shield assembly **9*a* have now slid along the associated rods 11 away from the brackets 13.**

Figure 4:
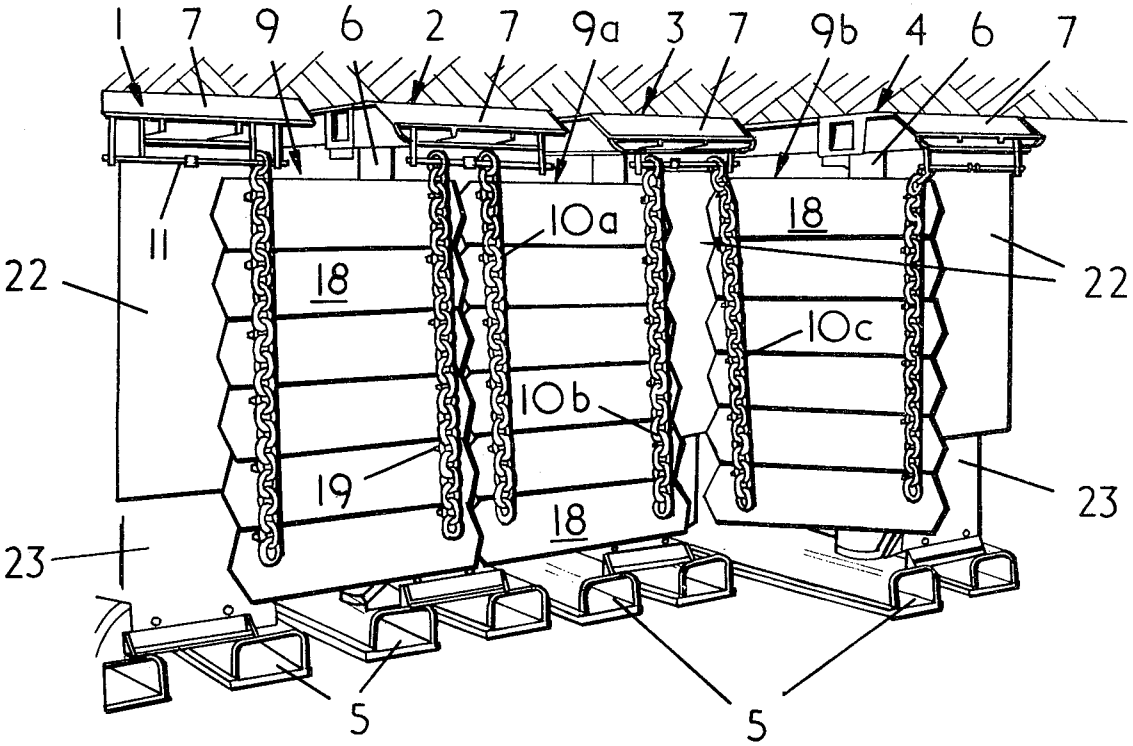
Figure 5:
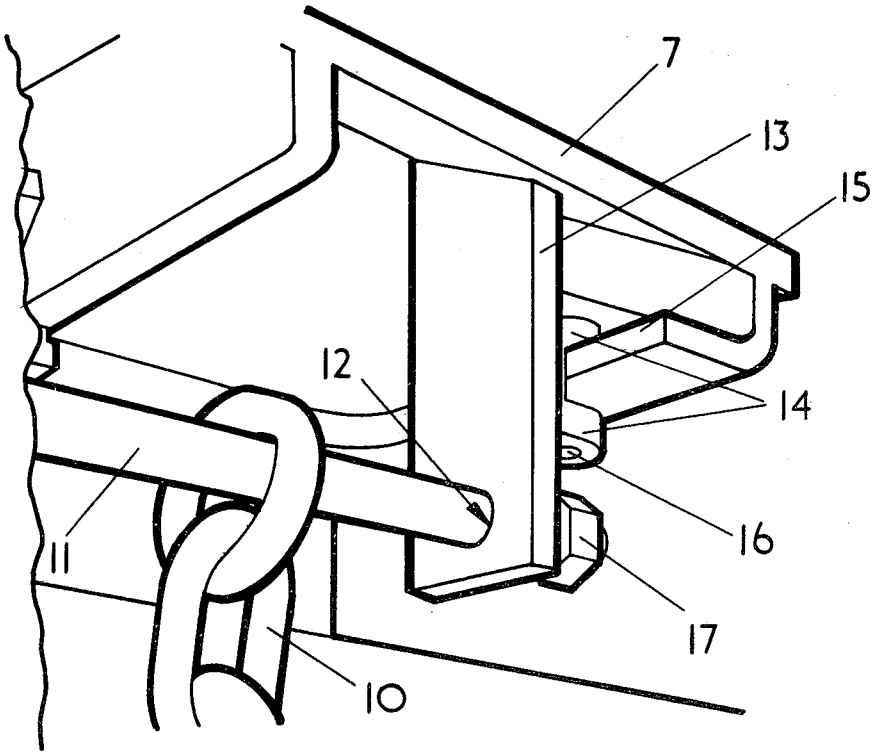
FIG. 5 shows a detail of FIGS. 1 to 4 on an enlarged scale.
Figure 6:
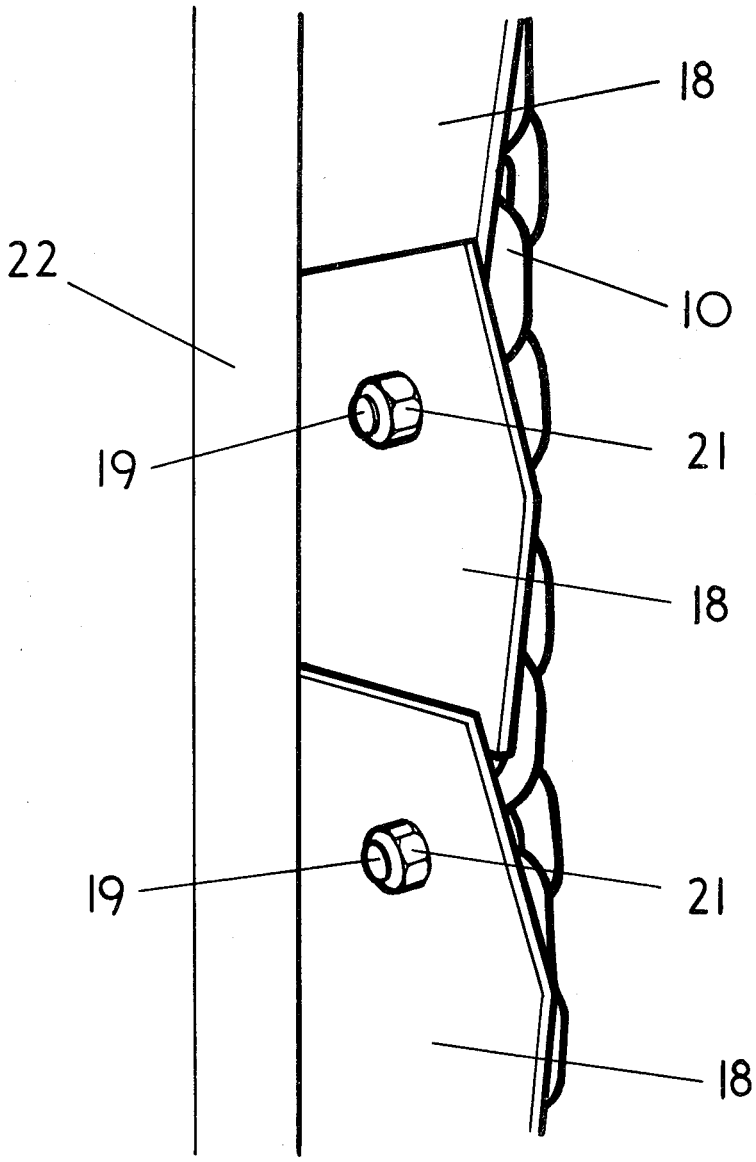
FIG. 6 is a front perspective view of a part of the mine roof support equipment of FIGS. 1 to 4 on an enlarged scale.

When fully advanced, the roof-support 3 is reset to the mine roof as seen in FIG. 4. The chains **10*b* and 10*c* are free to move up with the roof component 7 and the slats 18** return to their normal horizontal positions. Again the effectively continuous or closed curtain is maintained.

The next trailing roof-support 4 is then advanced in similar manner to that described with reference to roof-support 3.

It can be seen from the description that the invention provides mine roof-support equipment which provides an effectively continuous or closed curtain throughout the advance of the roof-supports and, thereby, prevents flow of broken rock material from the goaf through the line of roof-supports towards the working face.

The described construction has the additional advantage that the shield assemblies 9 can be easily and quickly assembled and installed to roof-supports on a longwall face. The separate parts of each shield assembly can be conveyed to the site and the shield assembly built up in position at the rear of the roof-support. This prevents the need for the manhandling of fully assembled prior known shield assemblies.

In modification of the mine roof-support equipment the bracket means may be welded to the roof canopy.

In further modifications a sheet is secured to the upper most slat so as to extend to the mine roof between two adjacent roof supports and prevent broken rock material flowing from the goaf when one of the supports is released from the roof.

In an alternative arrangement a shield assembly may replace the plate 22 secured to the rear of a single roof-support.

We claim:

1. In mine roof-support equipment for forming a shield assembly behind a plurality of advanceable roof support means on a longwall face in which each roof support means is advanced separately from the others by lowering the roof support means, advancing it and thereafter raising the roof support means to its support position comprising at least two flexible members one of which is suspended from a mine roof support means while the second flexible member is suspended from an adjacent roof support means and a plurality of cross elements each of which is securable to the two members at spaced points therealong, the improvement whereby said members at said spaced points have extending therefrom mounting means for pivotally securing each of the cross elements to each flexible member, the mounting means enabling each cross element to pivot independently of each flexible member and said flexible members to maintain themselves in a straight vertical position even when their roof support means is being advanced.

2. Equipment as claimed in claim 1, comprising a plurality of cross elements, each cross element overlapping an adjacent cross element.

3. Equipment as claimed in claim 2, in which the flexible members are constituted by lengths of round link chain and the pivotal mounting means comprise threaded pivot pins secured to links of the chain.

4. Equipment as claimed in claim 3, in which each of the pivot pins has a lock nut threaded thereon which loosely retains the associated cross element on the pivot pin and permits said cross element to freely pivot about the pivot pin.

* * * * *